US012055015B2

(12) United States Patent
Rowe et al.

(10) Patent No.: US 12,055,015 B2
(45) Date of Patent: Aug. 6, 2024

(54) DRILLING SYSTEM WITH GAS DETECTION SYSTEM FOR USE IN DRILLING A WELL

(71) Applicant: Halliburton Energy Services, Inc., Houston, TX (US)

(72) Inventors: Mathew Dennis Rowe, Spring, TX (US); Thuy Hanh Thi Blakey, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 24 days.

(21) Appl. No.: 17/211,118

(22) Filed: Mar. 24, 2021

(65) Prior Publication Data

US 2022/0307364 A1 Sep. 29, 2022

(51) Int. Cl.

| | |
|---|---|
| ***E21B 44/02*** | (2006.01) |
| ***E21B 4/02*** | (2006.01) |
| ***E21B 21/06*** | (2006.01) |
| ***E21B 44/00*** | (2006.01) |

(52) U.S. Cl.
CPC ..... *E21B 4/02* (2013.01); *E21B 21/067* (2013.01); *E21B 44/00* (2013.01)

(58) Field of Classification Search
CPC . E21B 44/02; E21B 7/067; E21B 4/02; F03B 13/02
See application file for complete search history.

(56) References Cited

U.S. PATENT DOCUMENTS

| | | | | |
|---|---|---|---|---|
| 4,319,482 | A * | 3/1982 | Bunner | G01N 33/0011 73/152.04 |
| 2006/0202122 | A1* | 9/2006 | Gunn | E21B 21/01 250/339.13 |
| 2011/0150686 | A1 | 6/2011 | Trushin et al. | |
| 2013/0008717 | A1* | 1/2013 | Deen | E21B 10/00 175/39 |
| 2014/0202767 | A1* | 7/2014 | Feasey | E21B 19/16 166/305.1 |

(Continued)

FOREIGN PATENT DOCUMENTS

| | | | |
|---|---|---|---|
| CN | 104246123 | A | 12/2014 |
| CN | 206220957 | U | 6/2017 |

(Continued)

OTHER PUBLICATIONS

International Search Report and Written Opinion dated Dec. 20, 2021 for corresponding PCT Application No. PCTUS2021024033 filed Mar. 25, 2021.

*Primary Examiner* — Tara Schimpf
*Assistant Examiner* — Yanick A Akaragwe
(74) *Attorney, Agent, or Firm* — K&L Gates LLP

(57) ABSTRACT

A drilling system for drilling a well. The drilling system may include a drillstring, a gas detector, and a computer system. The drillstring may include a downhole motor operable to rotate a drill bit and the downhole motor may include a stator and a rotor, at least one of the stator or the rotor comprising an elastomer compound. The gas detector may be operable to detect a gas indicative of deterioration of the elastomer compound. The computer system may be programmed to generate an indication based on the detection of the gas indicative of the deterioration by the gas detector.

25 Claims, 4 Drawing Sheets

(56) References Cited

U.S. PATENT DOCUMENTS

| | | | | |
|---|---|---|---|---|
| 2014/0379265 | A1* | 12/2014 | Beda | E21B 49/003 702/13 |
| 2015/0322720 | A1* | 11/2015 | Pelletier | E21B 10/602 175/41 |
| 2020/0386095 | A1* | 12/2020 | Dugas | G01N 29/223 |
| 2021/0180592 | A1* | 6/2021 | Costa De Oliveira | F03C 2/08 |
| 2022/0018816 | A1* | 1/2022 | Azizi | G01N 30/06 |
| 2022/0098968 | A1* | 3/2022 | Groover | E21B 47/06 |

FOREIGN PATENT DOCUMENTS

| | | | | |
|---|---|---|---|---|
| EP | 2235318 | B1 | 3/2015 | |
| WO | WO-2009139658 | A1 * | 11/2009 | E21B 4/02 |
| WO | WO-2016186653 | A1 * | 11/2016 | E21B 47/0005 |

* cited by examiner

DRILLING SYSTEM WITH GAS DETECTION SYSTEM FOR USE IN DRILLING A WELL

BACKGROUND

This section is intended to provide relevant background information to facilitate a better understanding of the various aspects of the described embodiments. Accordingly, these statements are to be read in this light and not as admissions of prior art.

Progressing cavity motors, also known as Moineau-type motors having a rotor that rotates within a stator using pressurized drilling fluid have been used in borehole drilling applications for many years. Some Moineau-type pumps and motors used in borehole drilling include stators having an elastomer compound bonded to a steel structure. Pressurized drilling fluid (e.g., drilling mud) is typically driven into the motor and into a cavity between the rotor and the stator, which generates rotation of the rotor and a resulting torque can be produced. The resulting torque is typically used to drive a working tool, such as a drill bit, to cut material.

However, over time the repeated flexing of the elastomer compound, the presence of abrasive particles in the fluid being pumped or driving the motor, chemical breakdown, high temperatures, and other factors can lead to failure of the elastomer compound. Failure of the elastomer compound can, in turn, lead to loss of sealing between the rotor and stator and cause the motor to stall.

Elastomer compounds are also used within a borehole to create dynamic seals between moving parts. However, similar to the elastomer compounds used for stators, the repeated flexing of the elastomer compound, the presence of abrasive particles in the fluid being pumped or driving the motor, chemical breakdown, high temperatures, and other factors can lead to failure of the elastomer compound. Failure of the elastomer compound can, in turn, cause fluid to pass through the dynamic seal.

BRIEF DESCRIPTION OF THE DRAWINGS

Embodiments of the drilling system with gas detection system are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a gas detection system for use in drilling a well. The gas detection system detects gases, such as carbon dioxide, sulfur dioxide, and/or hydrogen that are released as an elastomer compound in the downhole motor deteriorates. The presence of these gases in drilling fluids traveling uphole indicate that the elastomer portions of the downhole motor may be deteriorating, allowing the operator to take steps to avoid failure of the downhole motor.

By way of definition, a main borehole may in some instances be formed in a substantially vertical orientation relative to a surface of the well, and a lateral borehole may in some instances be formed in a substantially horizontal orientation relative to the surface of the well. However, reference herein to either the main borehole or the lateral borehole is not meant to imply any particular orientation, and the orientation of each of these boreholes may include portions that are vertical, non-vertical, horizontal or non-horizontal. Further, the term "uphole" refers a direction that is towards the surface of the well, while the term "downhole" refers a direction that is away from the surface of the well.

Figure 1:
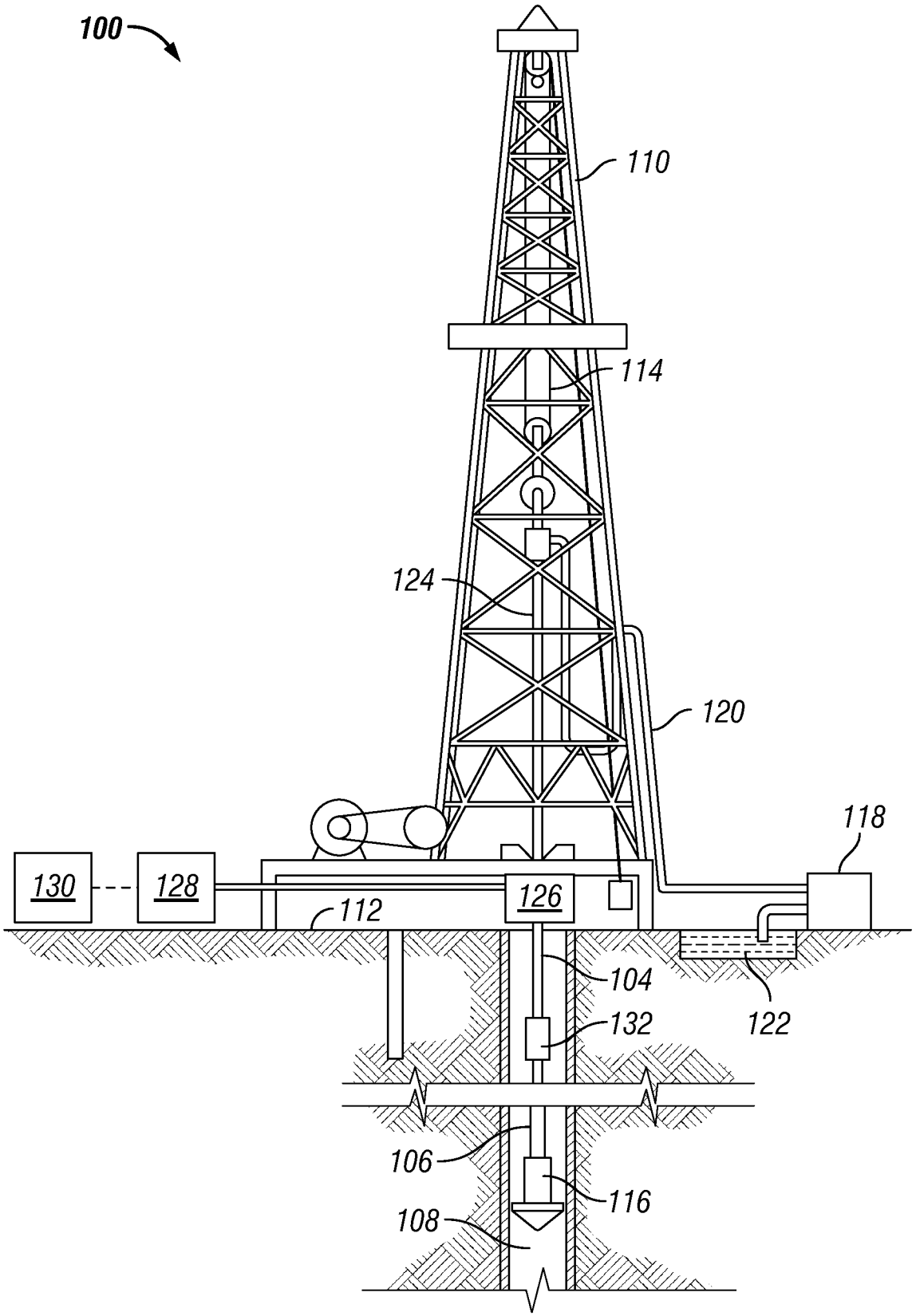
FIG. 1 is a schematic view of a well system, according to one or more embodiments.

FIG. 1 is a schematic view of a well system 100, according to one or more embodiments. The well system 100 includes a drilling rig 102 and a drillstring 104, which includes a bottom hole assembly ("BHA") 106 positioned in a borehole 108. The drilling rig 102 can include a mast 110 rising above ground 112 and be fitted with lifting equipment 114. The drillstring 104 is formed of drill pipes attached end to end (e.g., threadingly or otherwise), and is suspended into the borehole 108. A drill bit 116 is attached to the downhole end of the drillstring 104 to drill the borehole 108.

The drillstring 104 is connected to a mud pump 118 (e.g., through a hose 120), which permits the injection of drilling mud into the borehole 108 through the drillstring 104. The drilling mud can be drawn from a mud pit 122 that can be fed with surplus mud from the borehole 108. During drilling operations, the drillstring 104 can be driven in a rotary motion by means of a downhole motor, as described in more detail below, or alternatively by a kelly 124 fitted to an upper end of the drillstring 104.

In the exemplary embodiment, the well system 100 also includes a gas extractor 126 and a gas detection system 128. The gas detection system 128 may also be in electronic communication with a control system 130 that is used to control drilling operations. The gas extractor 126 separates gasses from fluids returned uphole during the course of drilling. The gasses are then flowed to the gas detection system 128. The gas detection system 128 includes a gas detector, such as, but not limited to, a gas chromatorgraph, a mass spectrometer, an infrared detector, or other gas phase detector, that detects the presence of carbon dioxide, sulfur dioxide, and/or hydrogen gas within the gasses that have traveled uphole with the fluids. Such gasses are indicative of deterioration of an elastomer compound in the downhole drilling motor, as described in more detail below. In another embodiment, the gas extractor 126 may be omitted and the gas detection system 128 may include a gas detector, such as, but not limited to, a liquid phase detector that utilizes liquid chromatography-mass spectroscopy, fourier-transform infrared spectroscopy, or Raman backscattering, that detects the presence of carbon dioxide, sulfur dioxide, and/or hydrogen gas within the fluids returned uphole. In other embodiments, the gas detection system 128 may be a part of the BHA 106 or positioned elsewhere along the drillstring 104 within the borehole 108, such as within a downhole tool 132.

Figure 2:
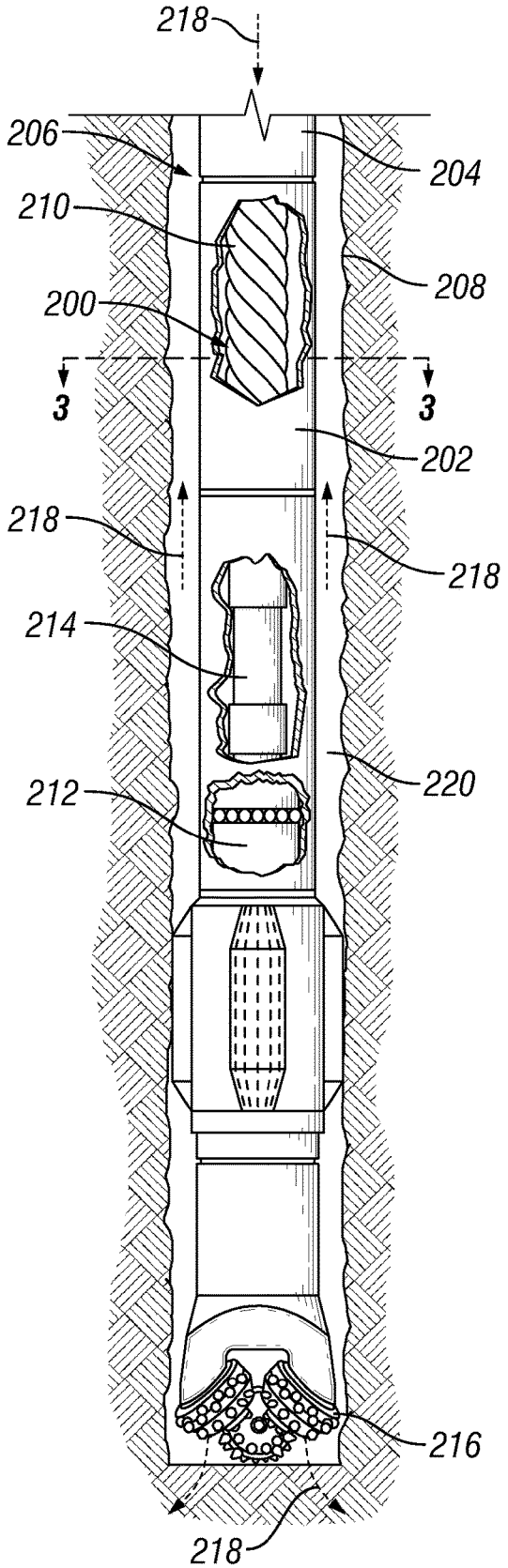
FIG. 2 is a drilling system disposed in a borehole.
Figure 3:
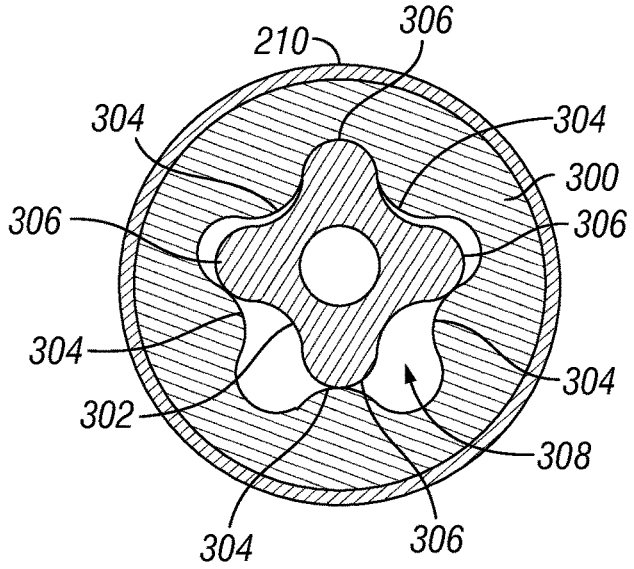
FIG. 3 is a cross-sectional view of the stator and rotor of FIG. 2.

FIGS. 2 and 3 are a broken side view and a cross section view of a BHA 206 disposed in a borehole 208 and that includes a downhole motor 200 connected to a drill bit 216. The downhole motor 200 includes a tubular housing 202 that encloses a power unit 210. The power unit 210 is connected to a bearing section assembly 212 via a transmission unit 214. Referring to FIG. 3, the power unit 210 includes a stator 300 and a rotor 302. The stator 300 includes multiple (e.g., five) lobes 304 extending along the stator 300 in a helical configuration and defining a cavity 308. The rotor 302 also includes lobes 306 extending along the rotor 302 in a helical configuration. The stator 300 and rotor 302 can also have more or fewer lobes where the difference between the rotor lobes 306 and stator lobes 304 is one extra stator lobe 304 for the number of rotor lobes 306.

The rotor 302 is operatively positioned in the cavity 308 such that the rotor lobes cooperate with the stator lobes 304 in that applying fluid pressure to the cavity 308 by flowing fluid within the cavity 308 causes the rotor 302 to rotate within the stator 300. For example, referring to FIGS. 2 and 3, pressurized drilling fluid (e.g., drilling mud) 218 can be introduced at an upper end of the power unit 210 and forced down through the cavity 308. The pressurized drilling fluid entering cavity 308, in cooperation with the lobes 304 of the stator 300 and the geometry of the stator 300 and the rotor 302 causes the rotor 302 to turn to allow the drilling fluid 218 to pass through the motor 200, thus rotating the rotor 302 relative to the stator 300. The drilling fluid 218 subsequently exits through ports (e.g., jets) in the drill bit 216 and travels upward through an annulus 220 between the drillstring 204 and the borehole 208 and is received at the surface where it is captured and pumped down the drillstring 204 again.

The downhole motor 200 falls into a general category referred to as Moineau-type motors. The downhole motor 200 is, however, generally subjected to greater torqueing loads than worm pumps that also fall into the general category of Moineau-type motors. This is particularly true with high power density (HPD) downhole motors 200 used in oil and gas well drilling.

The dynamic loading conditions typically involved in downhole drilling applications can generate substantial heat in the stator 300 and the rotor 302, which can lead to thermal degradation, and/or expansion (i.e., swelling) of elastomer within the downhole motor 200 and, therefore, can lead to increased wear and damage of the elastomer and to separation of the elastomer components from the housing. Further, elastomer on or making up either the stator 300 or the rotor 302 is susceptible to wear because of reduced clearance between the rotor 302 and the stator 300. The reduced clearance typically induces higher loads on the elastomer and causes wear is generally known as chunking. In some cases, the chunking of the elastomer can result in significant pressure loss so that the power unit is no longer able to produce suitable power levels to continue the drilling operation. Additionally, contact between the stator 300 and the rotor 302 during use can cause these components to wear or deform (i.e., the elastomer portion of the stator 300), which results in the spacing between the stator 300 and the rotor 302 to increase, reducing the power produced by the motor. Additionally, as the elastomer compounds deteriorate, carbon dioxide, sulfur dioxide, and/or hydrogen gas are produced and/or released. The released gas mixes with the drilling fluid 218 and is returned uphole.

Figure 4:
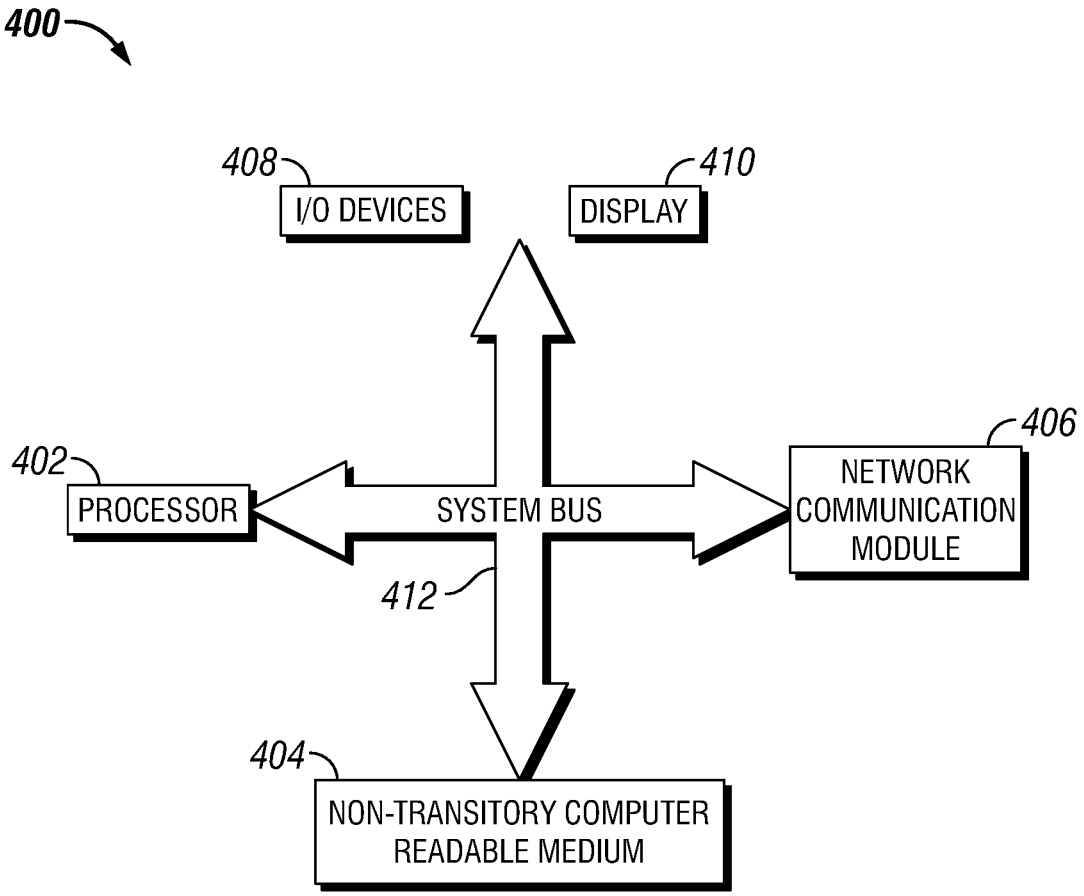
FIG. 4 is a block diagram of a computer system, according to one or more embodiments.

Turning now to FIG. 4, FIG. 4 is a computer system 400, according to one or more embodiments. The computer system 400 or a similar computer system may utilized by a gas detection system, such as the gas detection system 128 described above, in the detection of carbon dioxide, sulfur dioxide, and/or hydrogen gas. Additionally, the computer system 400 or a similar computer system may be utilized by a control system, such as the control system 130 described above, to control drilling operations. The computer system includes at least one processor 402, a non-transitory, computer-readable storage 404, a transceiver/network communication module 406, optional input/output devices 408, and an optional display 410 all interconnected via a system bus 412. Software instructions executable by the processor 402 for implementing software instructions stored within the computer system 400 in accordance with the illustrative embodiments described herein, may be stored in the storage 404 or some other non-transitory computer-readable medium.

Although not explicitly shown in FIG. 4, it will be recognized that the computer system 400 may be connected to one or more public and/or private networks via appropriate network connections. It will also be recognized that software instructions may also be loaded into the storage 404 from a CD-ROM or other appropriate storage media via wired or wireless means.

Figure 5:
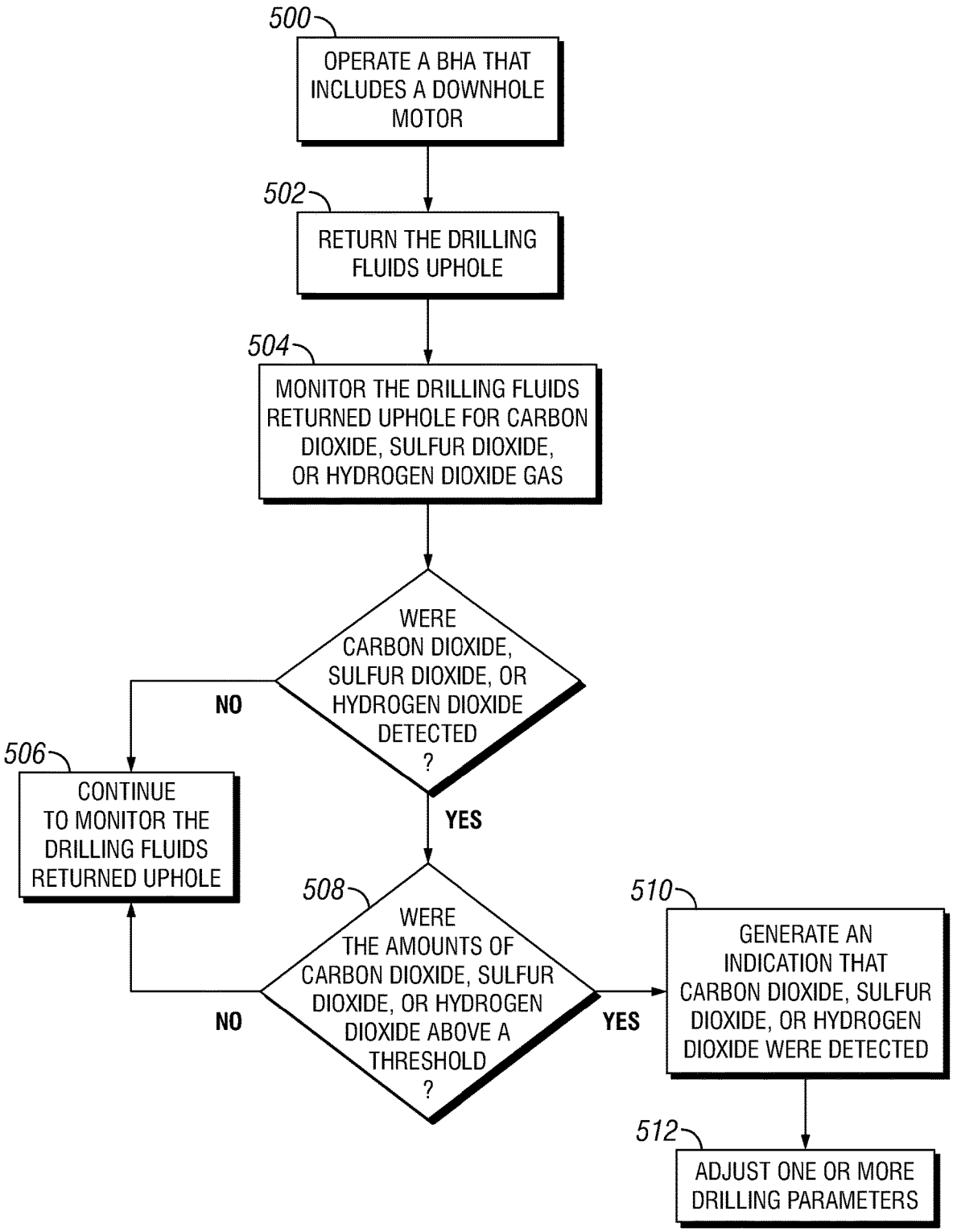
FIG. 5 is a flow chart of a method for drilling a well, according to one or more embodiments.

Turning now to FIG. 5, FIG. 5 is a flow chart of a method for drilling a well. The method may be performed by a computer system, such as the computer system 400 described above. The illustrated method enables an operator to determine when one or more elastomer compounds, such as the elastomer compound used in the downhole motor 200 described above, are deteriorating. Additionally, the computer system may take steps to mitigate further deterioration of elastomer compounds once deterioration of the elastomer compounds is detected.

In step 500, a BHA that includes a mud motor is operated, as described above with reference to FIGS. 2 and 3.

In step 502, the drilling fluid flowing downhole through the drillstring is returned uphole via the annulus formed between the drillstring and the borehole wall.

In step 504, the returned drilling fluid is monitored for carbon dioxide, sulfur dioxide, and/or hydrogen gas via a gas detection system, such as the gas detection system 128 described above. As previously discussed, the gas detection system may monitor gasses separated from the drilling fluid or the gas detection system may monitor the drilling fluid directly. Additionally, the gas detection system may be positioned on the surface, as shown in FIG. 1 or may be positioned within the BHA or along the drillstring within the borehole.

As shown in step 506, if carbon dioxide, sulfur dioxide, and/or hydrogen gas are not detected by the gas detection system, the gas detection system continues to monitor the drilling fluid returned uphole. If carbon dioxide, sulfur dioxide, and/or hydrogen gas are detected, the gas detection system then determines if the amount of carbon dioxide, sulfur dioxide, and/or hydrogen gas is above a predetermined threshold, as shown in step 508.

In at least one embodiment, the threshold may be a minimum absolute amount of carbon dioxide, sulfur dioxide, and/or hydrogen gas, such as at least approximately 1 part per million. In another embodiments, the threshold may be a relative increase over expected amounts of carbon dioxide, sulfur dioxide, and/or hydrogen gas or over previously detected amounts of carbon dioxide, sulfur dioxide, and/or hydrogen gas, such as approximately a 20% increase in the amount of carbon dioxide, sulfur dioxide, and/or hydrogen. In other embodiments, the threshold for an absolute amount of carbon dioxide, sulfur dioxide, and/or hydrogen gas may be greater than approximately 1 part per million. Similarly, further embodiments may utilize a threshold that is more than or less than approximately a 20% increase in the amount of carbon dioxide, sulfur dioxide, and/or hydrogen gas over expected or previously detected amounts of carbon dioxide, sulfur dioxide, and/or hydrogen gas.

If the detected amount of carbon dioxide, sulfur dioxide, and/or hydrogen gas is above the threshold, the gas detection system or another computer system, such as the control system 130 described above, generates an indication that carbon dioxide, sulfur dioxide, and/or hydrogen gas were detected, as shown in step 510. The indication may include, but is not limited to, an audible alarm, a message on a display, an electronic communication, such as a text message or an email, or any combination thereof.

In step 512, one or more drilling parameters may be adjusted by the gas detection system, the control system, or other means, including adjustment by an operator, based on the amount of carbon dioxide, sulfur dioxide, and/or hydrogen gas being over the threshold. Drilling parameters that may be adjusted include, but are not limited to, a flowrate of drilling fluid flowing through the drillstring, a torque generated by the downhole motor, a speed of the drill bit, a weight applied to the drill bit, or any combination thereof.

Further examples include:

Example 1 is a drilling system for drilling a well. The drilling system includes a drillstring, a gas detector, and a computer system. The drillstring includes a downhole motor operable to rotate a drill bit and the downhole motor includes a stator and a rotor, at least one of the stator or the rotor comprising an elastomer compound. The gas detector is operable to detect a gas indicative of deterioration of the elastomer compound. The computer system is programmed to generate an indication based on the detection of the gas indicative of the deterioration by the gas detector.

In Example 2, the embodiments of any preceding paragraph or combination thereof further include wherein the gas comprises at least one of carbon dioxide, sulfur dioxide, or hydrogen.

In Example 3, the embodiments of any preceding paragraph or combination thereof further wherein the gas detector is positionable at the Earth's surface.

In Example 4, the embodiments of any preceding paragraph or combination thereof further include wherein the computer system is programmed to generate the indication based on the detection of a minimum amount of the gas indicative of the deterioration.

In Example 5, the embodiments of any preceding paragraph or combination thereof further include wherein the computer system is programmed to generate the indication based on the detection of an increase in an amount of the gas indicative of the deterioration.

In Example 6, the embodiments of any preceding paragraph or combination thereof further include wherein the computer system is further programmed to adjust at least one of a flowrate of drilling fluid flowing through the drillstring, a torque generated by the downhole motor, a speed of the drill bit, or weight applied to the drill bit based on the detection of the gas indicative of the deterioration.

In Example 7, the embodiments of any preceding paragraph or combination thereof further include an extractor operable to separate gas from drilling fluid.

In Example 8, the embodiments of any preceding paragraph or combination thereof further include wherein the gas detector is operable to detect the gas indicative of deterioration of the elastomer compound in the separated gas.

In Example 9, the embodiments of any preceding paragraph or combination thereof further include wherein the gas detector is positionable within the well.

Example 10 is a method of drilling a well. The method includes operating a downhole motor including a stator and a rotor, where at least one of the stator or the rotor includes an elastomer compound. The method also includes detecting a gas indicative of deterioration of the elastomer compound in drilling fluids traveling uphole via a gas detector. The method further includes generating an indication based on the detection of the gas indicative of deterioration.

In Example 11, the embodiments of any preceding paragraph or combination thereof further include detecting the gas indicative of deterioration further comprises detecting at least one of carbon dioxide, sulfur dioxide, or hydrogen. The method further includes generating the indication further comprises generating the indication based on the detection of at least one of carbon dioxide, sulfur dioxide, or hydrogen.

In Example 12, the embodiments of any preceding paragraph or combination thereof further include wherein generating the indication comprises generating the indication based on the detection of a minimum amount of the gas indicative of deterioration.

In Example 13, the embodiments of any preceding paragraph or combination thereof further include wherein generating the indication comprises generating the indication based on the detection of an increase in an amount of the gas indicative of deterioration.

In Example 14, the embodiments of any preceding paragraph or combination thereof further include separating gas from the drilling fluids traveling uphole.

In Example 15, the embodiments of any preceding paragraph or combination thereof further include wherein detecting the gas indicative of deterioration of the elastomer compound comprises detecting the gas indicative of deterioration of the elastomer compound in the separated gas.

In Example 16, the embodiments of any preceding paragraph or combination thereof further include positioning the gas detector at the Earth's surface.

Example 17 is a gas detection system for use with a downhole motor comprising a stator and a rotor, where at least one of the stator or the rotor includes an elastomer compound. The gas detection system includes a gas detector and a computer system. The gas detector is operable to detect a gas indicative of deterioration of the elastomer compound. The computer system is programmed to generate an indication based on the detection of the gas by the gas detector.

In Example 18, the embodiments of any preceding paragraph or combination thereof further include wherein the gas comprises at least one of carbon dioxide, sulfur dioxide, or hydrogen.

In Example 19, the embodiments of any preceding paragraph or combination thereof further include wherein the computer system is programmed to generate the indication based on the detection of a minimum amount of the gas indicative of deterioration.

In Example 20, the embodiments of any preceding paragraph or combination thereof further include wherein the computer system is programmed to generate the indication based on the detection of an increase in an amount of the gas indicative of deterioration.

As used herein, the term "approximately" includes all values within 5% of the target value; e.g., approximately 100 includes all values from 95 to 105, including 95 and 105.

For the embodiments and examples above, a non-transitory machine-readable storage device can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

As used herein, the term "electronic communication" includes both wired communication between electronic components and/or electronic devices and wireless communication be between electronic components and/or electronic devices. "Electronic communication" also includes electronic components and/or electronic devices that are in wired or wireless electronic communication via intermediate electronic components and/or electronic devices.

In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A drilling system for drilling a well using a drilling fluid, the drilling system comprising:

a drillstring comprising a downhole motor operable to rotate a drill bit, the downhole motor comprising a stator and a rotor, at least one of the stator or the rotor comprising an elastomer compound;

a gas detector configured to detect a gas in the drilling fluid traveling uphole, wherein the gas is produced from deterioration of the elastomer compound; and a computer system programmed to generate an indication based on the detection of the gas above a predetermined threshold.

2. The drilling system of claim 1, wherein the gas further comprises at least one of sulfur dioxide, carbon dioxide, or hydrogen.

3. The drilling system of claim 1, wherein the predetermined threshold comprises at least one of a minimum amount of the gas over an expected amount of the gas or an increase in an amount of the gas over a previously detected amount of the gas.

4. The drilling system of claim 1, wherein the computer system is further programmed to adjust at least one of a flowrate of the drilling fluid flowing through the drillstring, a torque generated by the downhole motor, a speed of the drill bit, or weight applied to the drill bit based on the detection of the gas.

5. The drilling system of claim 1, further comprising an extractor operable to separate gasses from the drilling fluid, wherein the gas detector is operable to detect the gas within the separated gasses.

6. The drilling system of claim 1, wherein the gas detector is configured to detect one part per million of the gas.

7. A method of drilling a well, the method comprising:

operating a downhole motor comprising a stator and a rotor, at least one of the stator or the rotor comprising an elastomer compound;

detecting a gas in a drilling fluid traveling uphole via a gas detector, wherein the gas is produced from deterioration of the elastomer compound; and generating an indication based on the detection of the gas above a predetermined threshold.

8. The method of claim 7, wherein:

detecting the gas further comprises detecting at least one of sulfur dioxide, carbon dioxide, or hydrogen; and generating the indication further comprises generating the indication based on detection of at least one of sulfur dioxide, carbon dioxide, or hydrogen.

9. The method of claim 7, wherein the predetermined threshold comprises at least one of a minimum amount of the gas over an expected amount of the gas or an increase in an amount of the gas over a previously detected amount of the gas.

10. The method of claim 7, further comprising separating gases from the drilling fluid traveling uphole, wherein the gas detector is operable to detect the gas produced from deterioration of the elastomer compound of the downhole motor from the separated gasses.

11. A gas detection system for use with a downhole motor comprising a stator and a rotor, at least one of the stator or the rotor comprising an elastomer compound, the gas detection system comprising:

a gas detector configured to detect a gas in a drilling fluid traveling uphole, wherein the gas is produced from deterioration of the elastomer compound; and a computer system programmed to generate an indication based on the detection of the gas above a predetermined threshold by the gas detector.

12. The gas detection system of claim 11, wherein the gas further comprises at least one of sulfur dioxide, carbon dioxide, or hydrogen.

13. The gas detection system of claim 11, wherein the predetermined threshold comprises at least one of a minimum amount of the gas over an expected amount of the gas or an increase in an amount of the gas over a previously detected amount of the gas.

14. The gas detection system of claim 11, wherein the gas detector is configured to detect one part per million of the gas.

15. A drilling system for drilling a well using a drilling fluid, the drilling system comprising:

a drillstring comprising a downhole motor operable to rotate a drill bit, the downhole motor comprising a stator and a rotor, wherein at least one of the stator or the rotor comprises an elastomer compound;

a gas detector configured to detect a gas produced from deterioration of the elastomer compound, wherein the gas detector is operable to detect the gas directly from the drilling fluid returned uphole in the well without separating the gas from the drilling fluid; and a computer system programmed to generate an indication based on the detection of the gas above a predetermined threshold by the gas detector.

16. The drilling system of claim 15, wherein the predetermined threshold comprises at least one of a minimum amount of the gas over an expected amount of the gas or an increase in an amount of the gas over a previously detected amount of the gas.

17. The drilling system of claim 16, wherein the gas further comprises at least one of sulfur dioxide, carbon dioxide, or hydrogen.

18. The drilling system of claim 15, wherein the gas detector is configured to detect one part per million of the gas.

19. A method of drilling a well using a drilling fluid, the method comprising:

operating a downhole motor comprising a stator and a rotor, at least one of the stator or the rotor comprising an elastomer compound;

detecting a gas produced from deterioration of the elastomer compound, wherein the gas is detected directly from the drilling fluid traveling uphole via a gas detector without separating the gas from the drilling fluid; and generating an indication based on the detection of the gas above a predetermined threshold by the gas detector.

20. The method of claim 19, wherein the predetermined threshold comprises at least one of a minimum amount of the gas over an expected amount of the gas or an increase in an amount of the gas over a previously detected amount of the gas.

21. The method of claim 20, wherein the gas further comprises at least one of sulfur dioxide, carbon dioxide, or hydrogen.

22. A gas detection system for use with a downhole motor comprising a stator and a rotor, at least one of the stator or the rotor comprising an elastomer compound, the gas detection system comprising:

a gas detector configured to detect a gas produced from deterioration of the elastomer compound, wherein the gas detector is operable to detect the gas directly from drilling fluid traveling uphole without separating the gas from the drilling fluid; and a computer system programmed to generate an indication based on the detection of the gas above a predetermined threshold by the gas detector.

23. The gas detection system of claim 22, wherein the predetermined threshold comprises at least one of a minimum amount of the gas over an expected amount of the gas or an increase in an amount of the gas over a previously detected amount of the gas.

24. The gas detection system claim 23, wherein the gas further comprises at least one of sulfur dioxide, carbon dioxide, or hydrogen.

25. The gas detection system of claim 22, wherein the gas detector is configured to detect one part per million of the gas.

* * * * *